US009307873B1

(12) United States Patent
Glover et al.

(10) Patent No.: US 9,307,873 B1
(45) Date of Patent: Apr. 12, 2016

(54) HAND-WASHING MITT

(71) Applicants: Erica Glover, Summerville, SC (US); Henry Burks, Summerville, SC (US)

(72) Inventors: Erica Glover, Summerville, SC (US); Henry Burks, Summerville, SC (US)

( * ) Notice: Subject to any disclaimer, the term of this patent is extended or adjusted under 35 U.S.C. 154(b) by 2 days.

(21) Appl. No.: 14/493,492

(22) Filed: Sep. 23, 2014

(51) Int. Cl.
*A47K 7/03* (2006.01)

(52) U.S. Cl.
CPC ..... *A47K 7/03* (2013.01)

(58) Field of Classification Search
CPC ..... A47K 7/02; A47K 7/03; A61B 19/36; A61M 35/006
USPC ..... 401/7
See application file for complete search history.

(56) References Cited

U.S. PATENT DOCUMENTS

| | | | | |
|---|---|---|---|---|
| 3,711,889 | A | 1/1973 | Jennings | |
| 4,769,863 | A | 9/1988 | Tegg | |
| 5,331,705 | A | 7/1994 | Melov | |
| D413,477 | S | 9/1999 | Chaney | |
| 6,687,942 | B1 | 2/2004 | Pember | |
| 6,813,798 | B2 * | 11/2004 | Moga | A47K 7/03 15/104.93 |
| 2008/0179332 | A1 | 7/2008 | Sanders | |
| 2011/0088190 | A1 | 4/2011 | Clark | |
| 2012/0053536 | A1 * | 3/2012 | Moore | A61M 35/00 604/290 |
| 2013/0047365 | A1 | 2/2013 | Goldwasser | |

FOREIGN PATENT DOCUMENTS

| | | |
|---|---|---|
| WO | WO01/64091 | 11/2008 |

* cited by examiner

*Primary Examiner* — Jennifer C Chiang
*Assistant Examiner* — Bradley Oliver
(74) *Attorney, Agent, or Firm* — Kyle A. Fletcher, Esq.

(57) ABSTRACT

The hand-washing mitt includes a mitt with an opening into which a hand is inserted. The mitt includes a drawstring adjacent the opening in order to form a watertight seal with a wrist of said hand. The interior of the mitt is lined with an absorbent material. A cleaning solution bladder is located inside of said mitt, and when punctured shall release a cleaning solution onto said hand, which is used to wash the hand inside of the mitt. The end user would rub his or her hand around the interior of the mitt in order to wash the hand clean via the cleaning solution. The interior of the mitt includes bristle members on the interior surface to rub the hand against when washing the hand via the cleaning solution. The hand-washing mitt is a single-use item, which is discarded after use.

15 Claims, 4 Drawing Sheets

HAND-WASHING MITT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hand mitts or gloves, and more specifically, a mitt that is specially adapted to wash dirty hands that are inserted therein.

SUMMARY OF THE INVENTION

An embodiment of the disclosure meets the needs presented above by generally comprising a mitt with an opening into which a hand is adaptively inserted. The mitt includes a drawstring adjacent the opening in order to form a watertight seal with a wrist of said hand. The interior of the mitt is lined with an absorbent material. A cleaning solution bladder is located inside of said mitt, and when punctured shall release a cleaning solution onto said hand, which is used to wash the hand inside of the mitt. The end user would rub his or her hand around the interior of the mitt in order to wash the hand clean via the cleaning solution. Excess fluid is absorbed via the absorbent material. A piercing member is located on an exterior surface of the mitt, and when depressed shall puncture the cleaning solution bladder in order to dispense the cleaning solution. The interior of the mitt includes bristle members on the interior surface to rub the hand against when washing the hand via the cleaning solution. The hand-washing mitt is a single-use item, which is discarded after use.

These together with additional objects, features and advantages of the hand-washing mitt will be readily apparent to those of ordinary skill in the art upon reading the following detailed description of presently preferred, but nonetheless illustrative, embodiments of the hand-washing mitt when taken in conjunction with the accompanying drawings.

In this respect, before explaining the current embodiments of the hand-washing mitt in detail, it is to be understood that the hand-washing mitt is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hand-washing mitt.

It is therefore important that the claims be regarded as including such equivalent construction insofar as they do not depart from the spirit and scope of the hand-washing mitt. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
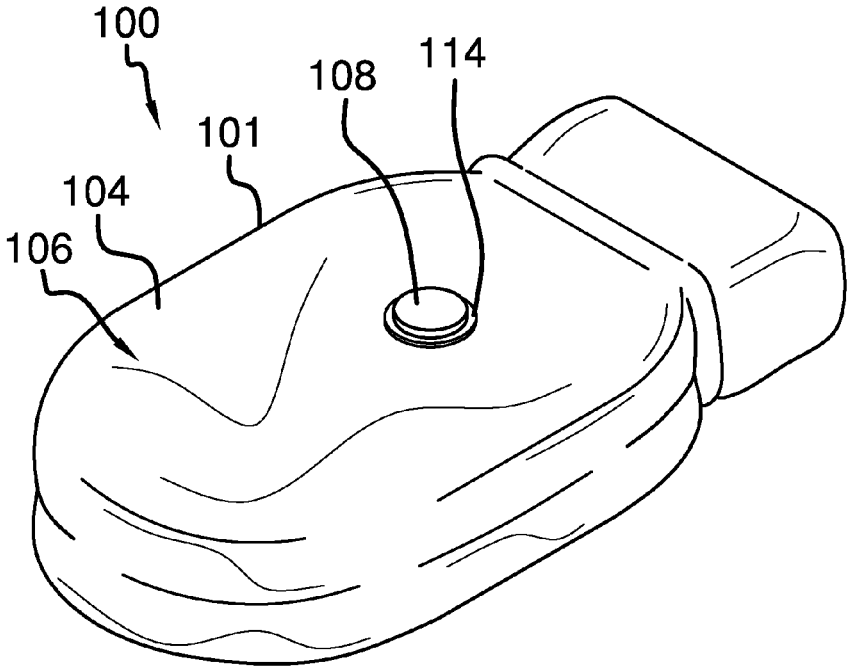
FIG. 1 is a perspective view of an embodiment of the disclosure.
Figure 2:
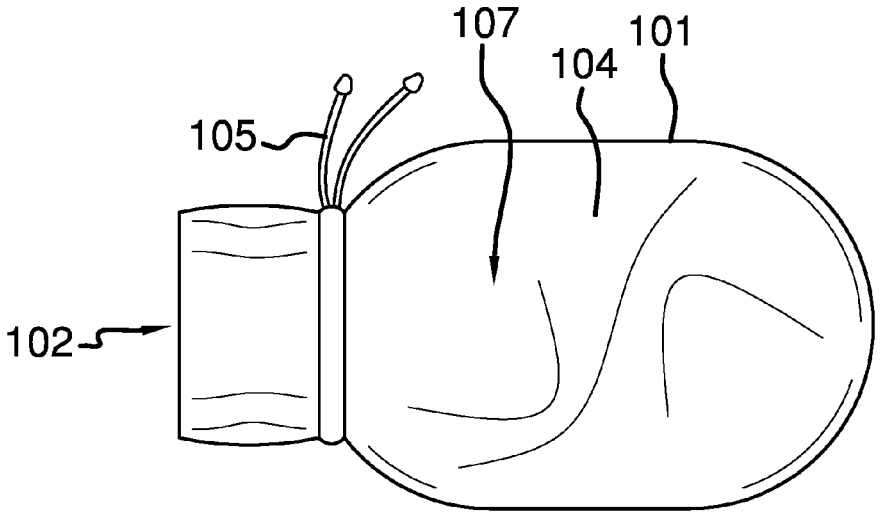
FIG. 2 is a bottom view of an embodiment of the disclosure.
Figure 3:
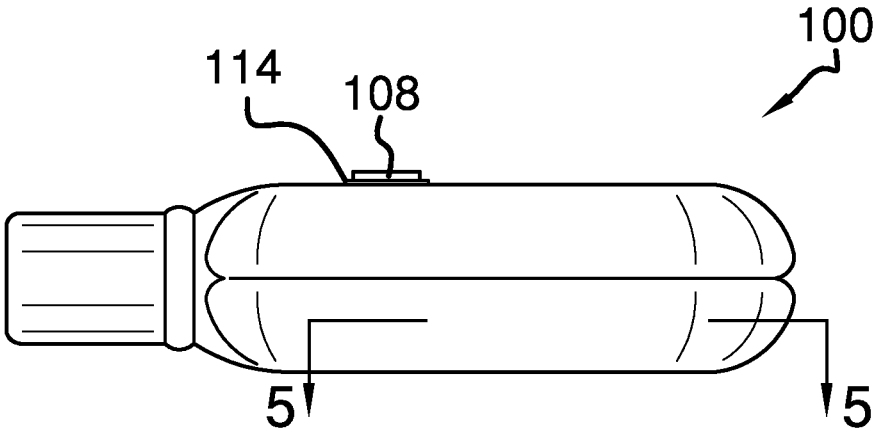
FIG. 3 is a side view of an embodiment of the disclosure.
Figure 4:
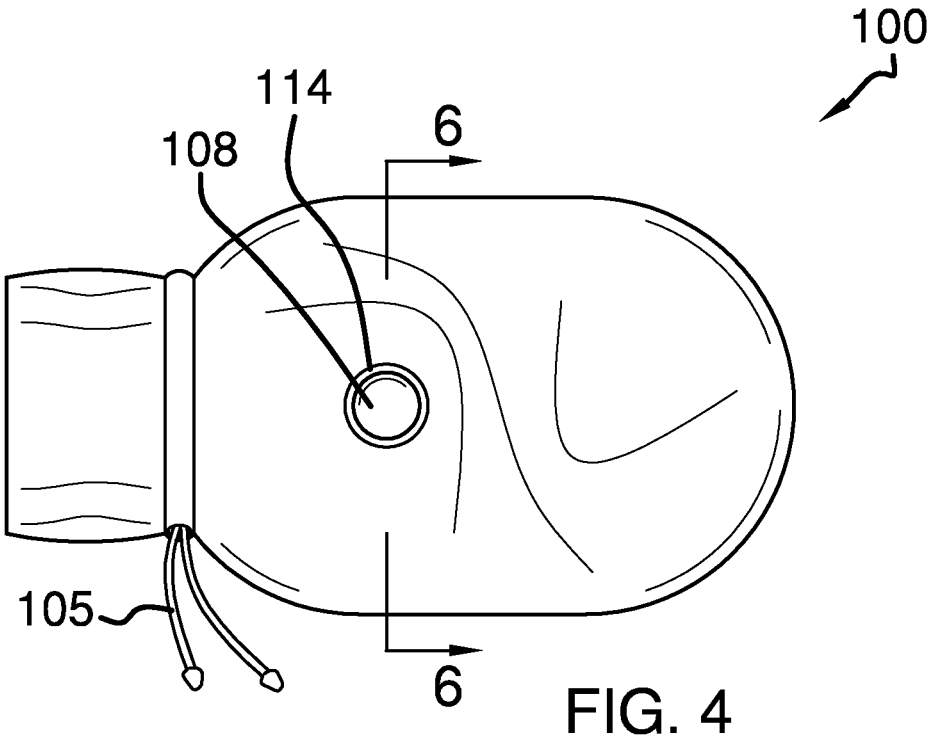
FIG. 4 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 7, the hand-washing mitt 100 (hereinafter invention) generally comprises a mitt 101 with an opening 102 that provides ingress and egress from an interior 103. The mitt 101 is further defined with an exterior surface 104, which includes a drawstring 105 adjacent the opening 102. The drawstring 105 enables the size of the opening 102 to be constricted in order to adaptively form a watertight seal with a wrist 201 of a hand 200. The exterior surface 104 may be further defined with a top mitt surface 106 and a bottom mitt surface 107.

The top mitt surface 106 includes a piercing button 108 that when depressed inserts a blade member 109 into a cleaning solution bladder 110. The cleaning solution bladder 110 is located inside of the mitt 101. Moreover, the cleaning solution bladder 110 is provided on the interior 104 of the mitt 101. The cleaning solution bladder 110 is adjacent the top mitt surface 106. The mitt 101 is lined with an impermeable layer 111 that spans the entire interior 103 of the mitt 101 in order to prevent leakage of fluid contents from the interior 103 of the mitt 101. The cleaning solution bladder 110 stores a cleaning solution 112 that is dispensed upon depressing the piercing button 108.

Figure 6:
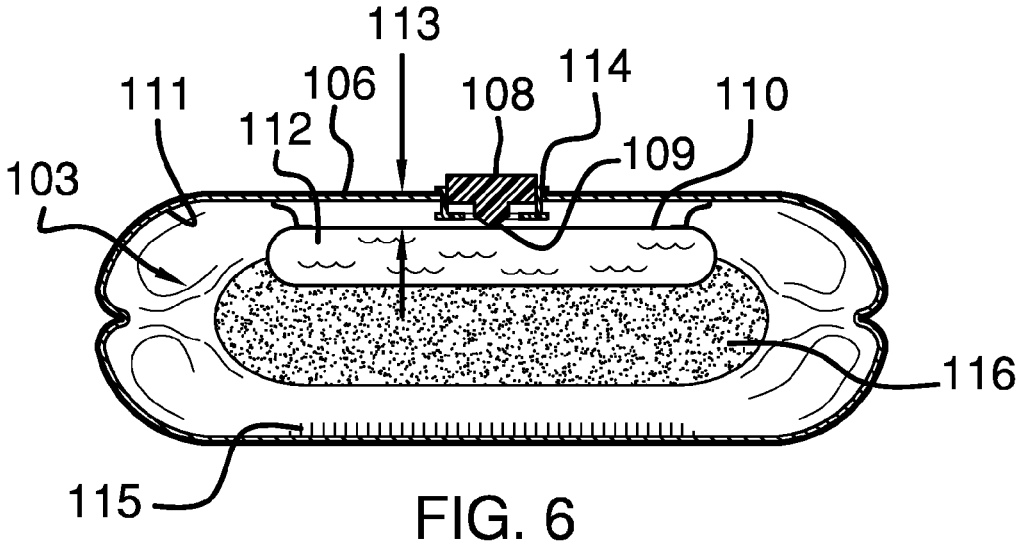
FIG. 6 is another cross-sectional view along line 6-6 in FIG. 4 of an embodiment of the disclosure.

Referring to FIG. 6, the cleaning solution bladder 110 is recessed from the impermeable layer 111. The cleaning solution 110 is separated from the impermeable layer 111 via a piercing depth 113. The piercing button 108 is seated against a piercing gasket 114 that forms a watertight seal between the piercing button 108 and the interior 103 of the mitt 101.

Figure 5:
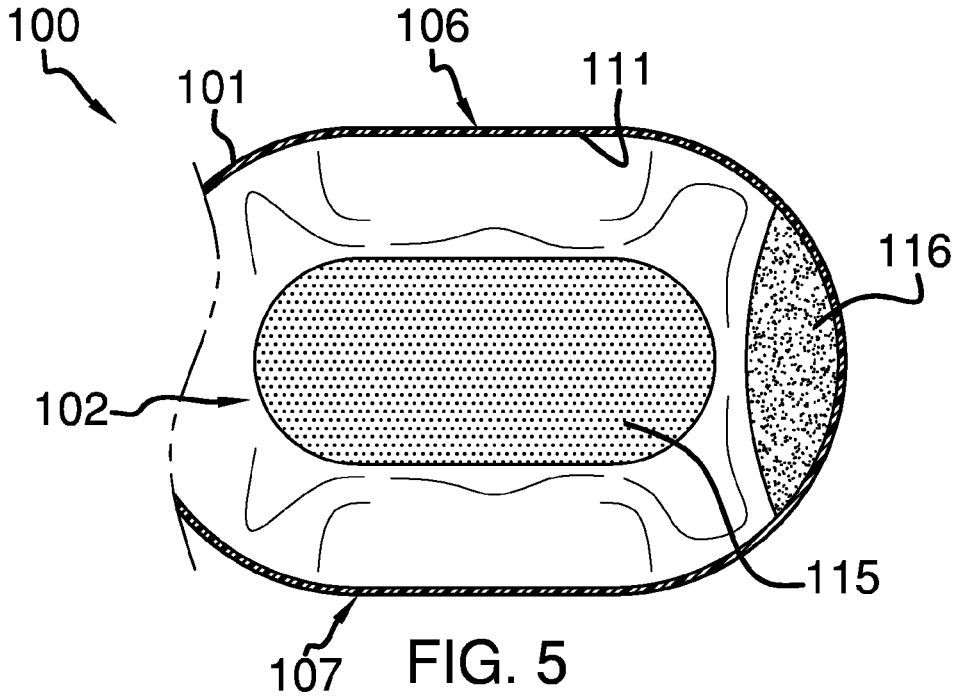
FIG. 5 is a cross-sectional view along line 5-5 in FIG. 3 of an embodiment of the disclosure.
Figure 7:
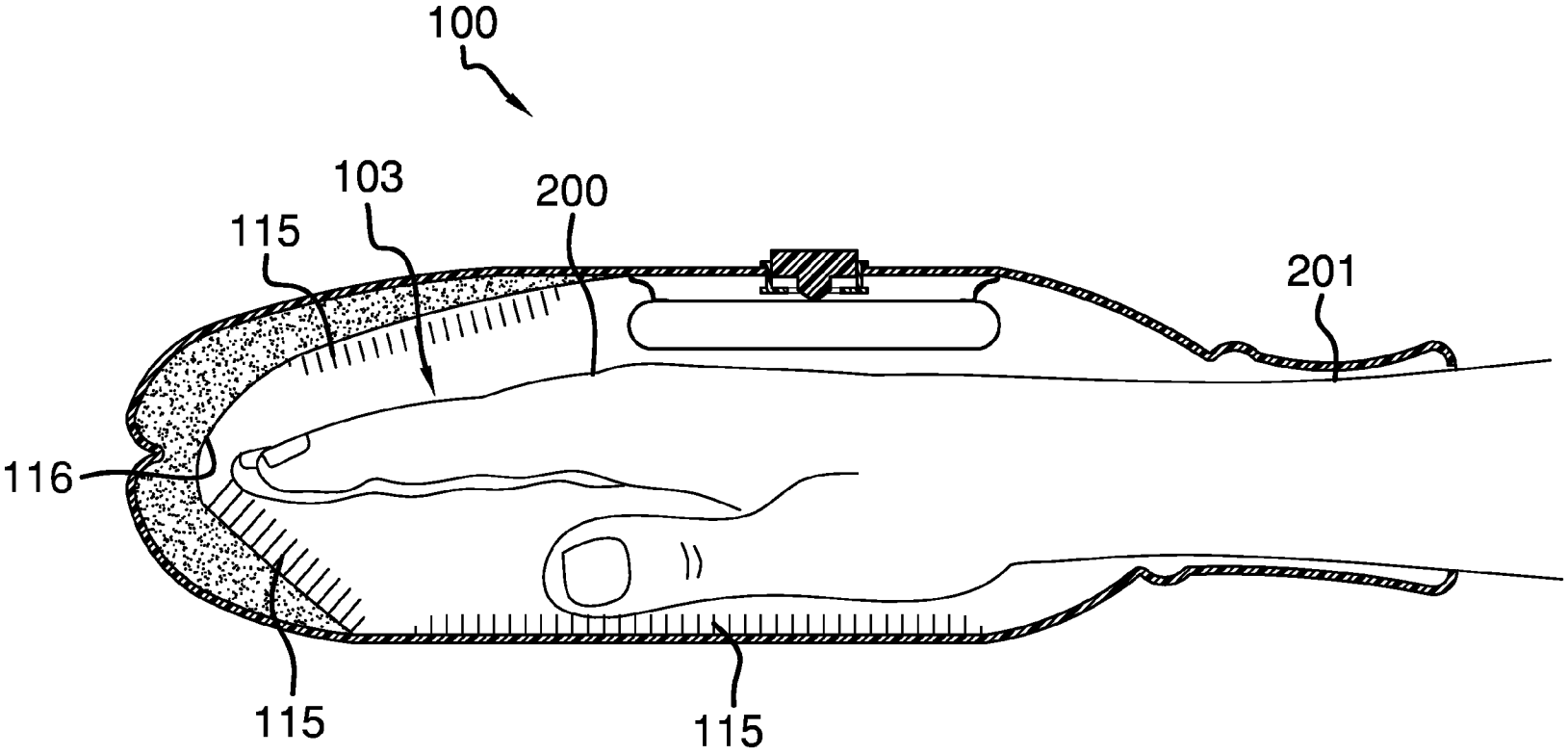
FIG. 7 is a detailed view of an embodiment of the disclosure in use.

Referring to FIGS. 5-7, the interior 103 of the mitt 101 is lined with at least one bristles member 115. The at least one bristles member 115 is affixed to the impermeable layer 111. The at least one bristles member 115 is adapted to scrub the hand 200 inside of the mitt 101 when the invention 100 is in use. The mitt 101 also includes at least one absorbent member 116 located in the interior 103 of the mitt 101. The at least one absorbent member 116 is responsible for absorbing all excess fluid that is produced as a result of washing the hand 200 via the cleaning solution 112. The at least one absorbent member 116 may be located along portions of the interior of the mitt 101 not occupied via the at least one bristles member 115. The at least one absorbent member 116 may be made of an absorbent gel. The at least one absorbent member 116 may be affixed to the impermeable layer 111 of the mitt 101.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hand-washing mitt comprising:

a mitt that is configured to be used to wash a hand placed therein;

said mitt includes a cleaning solution bladder that dispenses a cleaning solution on said hand;

said hand is adapted to rub against at least one bristles member provided inside of said mitt in order to scrub said hand;

wherein the mitt includes an opening that provides ingress and egress from an interior; wherein the mitt is further defined with an exterior surface, which includes a drawstring adjacent the opening;

wherein the drawstring enables the size of the opening to be constricted in order to adaptively form a watertight seal with a wrist of said hand;

wherein the exterior surface is further defined with a top mitt surface and a bottom mitt surface;

wherein the top mitt surface includes a piercing button that when depressed inserts a blade member into the cleaning solution bladder.

2. The hand-washing mitt according to claim 1 wherein the cleaning solution bladder is located inside of the mitt; wherein the cleaning solution bladder is provided on the interior of the mitt.

3. The hand-washing mitt according to claim 2 wherein the cleaning solution bladder is adjacent the top mitt surface.

4. The hand-washing mitt according to claim 3 wherein the mitt is lined with an impermeable layer that spans the entire interior of the mitt in order to prevent leakage of fluid contents from the interior of the mitt; wherein the cleaning solution bladder stores a cleaning solution that is dispensed upon depressing the piercing button.

5. The hand-washing mitt according to claim 4 wherein the cleaning solution bladder is recessed from the impermeable layer; wherein the cleaning solution bladder is separated from the impermeable layer via a piercing depth.

6. The hand-washing mitt according to claim 5 wherein the piercing button is seated against a piercing gasket that forms a watertight seal between the piercing button and the interior of the mitt.

7. The hand-washing mitt according to claim 6 wherein the least one bristles member is affixed to the impermeable layer.

8. The hand-washing mitt according to claim 7 wherein the mitt also includes at least one absorbent member located in the interior of the mitt; wherein the at least one absorbent member is responsible for absorbing all excess fluid that is produced as a result of washing the hand via the cleaning solution.

9. The hand-washing mitt according to claim 8 wherein the at least one absorbent member is located along portions of the interior of the mitt not occupied via the at least one bristles member; wherein the at least one absorbent member is affixed to the impermeable layer of the mitt.

10. A hand-washing mitt comprising:

a mitt that is configured to be used to wash a hand placed therein;

said mitt includes a cleaning solution bladder that dispenses a cleaning solution on said hand;

said hand is adapted to rub against at least one bristles member provided inside of said mitt in order to scrub said hand;

wherein the mitt includes an opening that provides ingress and egress from an interior; wherein the mitt is further defined with an exterior surface, which includes a drawstring adjacent the opening;

wherein the drawstring enables the size of the opening to be constricted in order to adaptively form a watertight seal with a wrist of said hand;

wherein the exterior surface is further defined with a top mitt surface and a bottom mitt surface; wherein the top mitt surface includes a piercing button that when depressed inserts a blade member into the cleaning solution bladder; wherein the cleaning solution bladder is located inside of the mitt; wherein the cleaning solution bladder is provided on the interior of the mitt.

11. The hand-washing mitt according to claim 10 wherein the cleaning solution bladder is adjacent the top mitt surface; wherein the mitt is lined with an impermeable layer that spans the entire interior of the mitt in order to prevent leakage of fluid contents from the interior of the mitt; wherein the cleaning solution bladder stores a cleaning solution that is dispensed upon depressing the piercing button; wherein the cleaning solution bladder is recessed from the impermeable layer; wherein the cleaning solution bladder is separated from the impermeable layer via a piercing depth.

12. The hand-washing mitt according to claim 11 wherein the piercing button is seated against a piercing gasket that forms a watertight seal between the piercing button and the interior of the mitt.

13. The hand-washing mitt according to claim 12 wherein the least one bristles member is affixed to the impermeable layer.

14. The hand-washing mitt according to claim 13 wherein the mitt also includes at least one absorbent member located in the interior of the mitt; wherein the at least one absorbent member is responsible for absorbing all excess fluid that is produced as a result of washing the hand via the cleaning solution.

15. The hand-washing mitt according to claim 14 wherein the at least one absorbent member is located along portions of the interior of the mitt not occupied via the at least one bristles member; wherein the at least one absorbent member is affixed to the impermeable layer of the mitt.

* * * * *